US005080261A

United States Patent [19]

Green

[11] Patent Number: 5,080,261

[45] Date of Patent: Jan. 14, 1992

[54] SODA GENERATOR AND COOLER FOR SOFT DRINK DISPENSER

[75] Inventor: Thomas S. Green, Kent, Ohio

[73] Assignee: ABCC/TechCorp, Akron, Ohio

[21] Appl. No.: 583,192

[22] Filed: Sep. 17, 1990

[51] Int. Cl.[5] ..... B67D 5/62

[52] U.S. Cl. ..... 222/129.1; 222/131; 222/146.6

[58] Field of Search ..... 222/146.6, 129.1, 131

[56] References Cited

U.S. PATENT DOCUMENTS

| | | | |
|---|---|---|---|
| 2,732,977 | 1/1956 | Charpiat | 222/131 |
| 3,224,641 | 12/1965 | Morgan | 222/146.6 |
| 3,240,395 | 3/1966 | Carver | 222/129.1 |
| 3,712,514 | 1/1973 | LeBlanc | 222/146.6 |
| 4,162,029 | 7/1979 | Gottsegen et al. | 222/131 |
| 4,555,045 | 11/1985 | Rodth et al. | 222/129.1 |
| 4,958,505 | 9/1990 | Swanson | 222/146.6 |

*Primary Examiner*—Kevin P. Shaver
*Assistant Examiner*—Shari M. Wunsch
*Attorney, Agent, or Firm*—Renner, Kenner, Greive, Bobak, Taylor & Weber

[57] ABSTRACT

A soft drink dispenser is provided with a soda generator and cooling tank which employs the consumable ice from an ice bin as a source for cooling the soda while being maintained apart from the ice. Both the ice bin and soda tank are maintained upon a common cooling plate having serpentine passages for prechilling water before introduction into the soda tank. The ice within the bin serves as an energy source for the cooling plate which acts as a heat sink to provide a thermally conductive path for assuring that the soda within the tank is kept at a desirably low level.

10 Claims, 1 Drawing Sheet

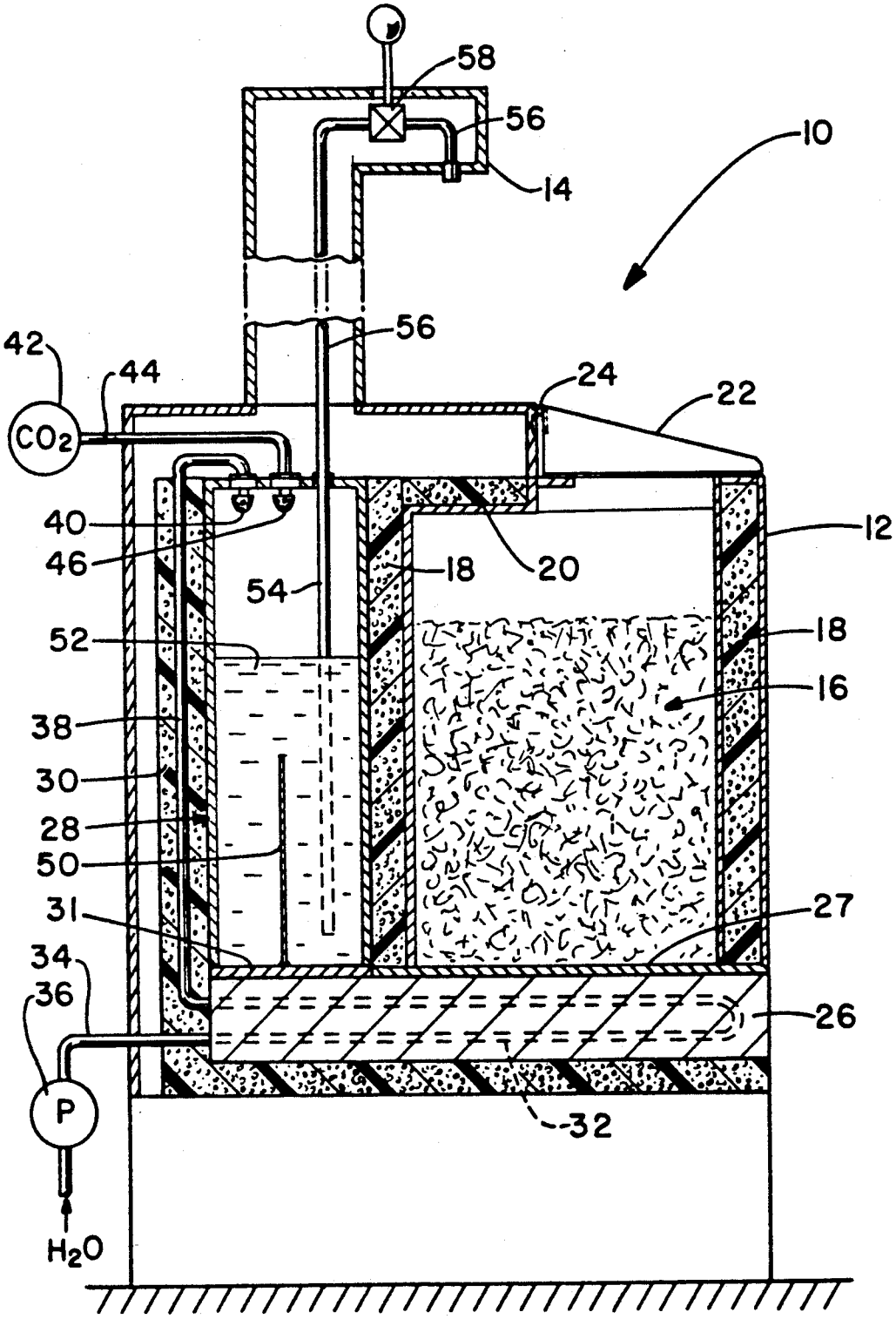
58
56
10
14
56
42
44
24
22
$CO_2$
40
46
54
18
20
12
52
18
16
38
30
28
50
31
27
34
36
26
P
32
$H_2O$

SODA GENERATOR AND COOLER FOR SOFT DRINK DISPENSER

TECHNICAL FIELD

The invention herein resides in the art of soft drink dispensers and, more particularly, to a soda generator and cooler for such dispensers. Specifically, the invention relates to a soft drink dispenser in which the soda tank is maintained in thermal contact with the ice bin of the dispenser, while being isolated from the ice itself.

BACKGROUND ART

It is well known that soft drinks typically comprise a combination of syrup and soda, the latter being the main ingredient of such drinks, and constituting carbonated water which is generated by the entraining of carbon dioxide ($CO_2$) gas into water under pressure.

If an insufficient quantity of $CO_2$ gas is entrained in the water, the soda or resulting soft drink has a "flat" taste, the same typically being quite unacceptable. It is well known in the art that it is important that carbonated water be maintained at a cool or cold temperature, approaching the freezing point of water. The colder the soda, the more $CO_2$ that can be maintained therein, providing the soda with a more lively taste. Additionally, when the soft drink is dispensed the temperature of the soft drink, being above the freezing point of the ice onto which it is dispensed, will typically melt some of the ice until the ice and soft drink combination reaches a point of equilibrium. It is most desirable that the soda be as cold as possible so that the tendency to melt ice is reduced, particularly since the melting of ice dilutes the drink not only with respect to its sweetness or brix level, but also renders the drink flat by reducing the concentration of $CO_2$ therein.

Since it is desirable to keep the soda source as cold as possible, it was previously known to place the soda tank in the ice bin of the soft drink dispenser itself. However, this ice bin provides the source of ice placed in the cups in which the soft drinks are served to customers. Accordingly, health agencies now prohibit such placement of the soda tank within the ice bin of the consumable ice.

Presently, the carbonation or soda tank is kept apart from the ice bin itself. The water used for generating the soda is run through a cooling plate which lowers the temperature of the water to a level depending upon the original temperature of the water itself. This prechilled water is then introduced into the soda tank where $CO_2$ gas is applied under a pressure head to entrain the gas in the water. At the time of dispensing the soft drink, soda from the soda tank is again run through the cooling plate so that the soda is cool at the time of dispensing. Such present systems are highly inefficient, typically resulting in soda dispensing temperatures much higher than optimum.

In the prior art, cooling of the soda was performed dynamically and in stages. The water was cooled before it entered the soda or carbonation tank, and the soda was cooled again immediately prior to dispensing. Both cooling operations were typically performed by running the water through a cooling plate before entering the carbonation tank, and by running the soda from the tank through the cooling plate to the dispensing head. No cooling was performed in the carbonation tank itself which, being uninsulated, allowed the soda to warm toward ambient.

The prior art fails to teach a soda tank serving as both a generator and cooler and in which the soda is continually cooled by the ice in the ice bin while being maintained apart therefrom. Further, the prior art fails to teach a soda tank which is capable of efficiently generating and maintaining soda while assuring a cool dispensing temperature to prevent dilution of the resulting soft drink through the melting of ice.

Indeed, the prior art fails to teach the cooling of soda in a soda tank apart from the ice bin, while employing the ice bin as the cooling media, and in which the cooling efficiency is independent of the level of ice within the ice bin. Further, the prior art fails to teach the implementation of the ice bin as the cooling media and in which the ice bin walls are so insulated and isolated from the soda tank to preclude sweating of the walls.

DISCLOSURE OF INVENTION

In light of the foregoing, it is a first aspect of the invention to provide a soda generator and cooler which keeps the soda constantly cold, during generation, storage, and dispensing, the cooling function thereof being continually performed.

Another aspect of the invention is the provision of a soda generator and cooler which employs consumable ice from the ice bin of the soft drink dispenser as the media for cooling the soda.

A further aspect of the invention is the provision of a soda generator and cooler in which the cooling efficiency thereof is substantially independent of the amount of ice in the ice bin employed as the cooling media.

Another aspect of the invention is the provision of a soda generator and cooler which employs an ice bin as the cooling media and in which sidewalls of the ice bin are insulated to prevent sweating.

Yet another aspect of the invention is the provision of a soda generator and cooler which is efficient and reliable in use.

Still another aspect of the invention is the provision of a soda generator and cooler which is conducive to implementation with state of the art beverage dispensing systems.

The foregoing and other aspects of the invention which will become apparent as the detailed description proceeds are achieved by a soft drink dispenser, comprising: an ice bin; and a soda generation and cooling tank maintained external to and thermally interconnected with said ice bin.

Other aspects of the invention which will become apparent herein are attained by a soft drink dispenser, comprising: and ice bin; a soda tank in juxtaposition to said ice bin and external to said ice bin; and a cooling plate interconnecting a bottom surface of said ice bin with a bottom surface of said soda tank.

DESCRIPTION OF DRAWING

For a complete understanding of the objects, techniques, and structure of the invention reference should be made to the following detailed description and accompanying drawing wherein there is shown an illustrative partial sectional view of a soft drink dispenser according to the invention, showing the novel soda generator and cooler thereof.

BEST MODE FOR CARRYING OUT THE INVENTION

Referring now to the drawing, it can be seen that a soft drink dispenser according to the invention is designated generally by the numeral 10. The dispenser 10 is defined by a housing 12 of sheet metal or other suitable material, having a dispensing head 14 extending thereabove. As is well known to those skilled in the art, soda and syrup lines are nested at the dispensing head 14 and are operative under valve control to dispense a combination of soda and syrup into a cup positioned therebelow. Typically, the cup will have a measure of ice therein, such ice having been taken from an ice bin 16. The ice, typically in "cube" or crushed form, is kept in a frozen state within the ice bin 16 by the presence of insulated walls 18 on the four sides thereof and an insulated top 20 covering the same. The top 20 is provided with an opening therein covered by a lid 22 which is hinged at 24 to allow access to the interior of the ice bin 16 in standard fashion.

A cooling plate 26 receives a bottom plate 27 of the bin 16, the plates 26, 27 making intimate contacting engagement with each other to allow for thermal conduction therebetween. It is also contemplated that the cooling plate may itself constitute the bottom plate of the bin 16. The cooling plate 26 is preferably of a metal having high thermal conductivity characteristics, such as aluminum, stainless steel, or the like. The plate 27 is typically made of similar materials, as are the interior walls of the ice bin 16. In any event, it is preferred that the plates 26, 27 be thermally conductive to a high degree, and that the same engage over substantially the entire areas thereof.

Also received upon the cooling plate 26 is a soda generator or carbonation and cooling tank 28. Typically, the soda tank 28 will be of cylindrical nature, constructed of stainless steel, aluminum, or the like. A layer of insulation 30 is provided to encompass the cylindrical shell of the tank 28 about the sides thereof, with the bottom plate 31 thereof resting intimately upon the cooling plate 26 with an interposed thermally conductive layer for good thermal transfer therebetween. Accordingly, it will be appreciated that ice received within the bin 16 impacts upon the bottom plate 27 thereof, providing an effective heat sink through the cooling plate 26 to the soda tank 28 having its base plate 31 received upon the cooling plate 26.

It will also be seen that a plurality of serpentine passages 32 pass through the cooling plate 26 and are interconnected with a water conduit 34 which is connected to a water supply such as a municipal water supply or the like. A pump 36 is operative to pressurize and regulate the passage of water from the water supply through the water conduit 34 and serpentine passage 32 to the conduit 38 which feeds to the spray nozzle 40 interior of the soda tank 28. A source 42 of pressurized $CO_2$ gas interconnects through a conduit 44 with the spray head or nozzle 46. Water is introduced into the tank 28 under control of the pump 36 on demand, while a pressure head of $CO_2$ gas is continually maintained within the tank 18 from the source and nozzle 46.

An output conduit 54 is received within the tank 28 and interconnects with the soda line 56 which passes to the dispensing head 14 through the dispensing control valve 58. Those skilled in the art will recognize that soda is dispensed under the force of $CO_2$ pressure head within the tank 28 upon opening of the valve 58. When water is introduced through the nozzle 40 into the tank 28, the turbulence created forces bubbles of $CO_2$ gas below the soda level 52. To prevent such gas bubbles from entering the soda line 56, the conduit 54 is isolated or baffled from the nozzle 40 by means of the plate 50 extending upwardly from the base plate 31 and crossing the interior of the tank 28. With the baffle plate 50 of stainless steel or other thermally conductive material, the plate 50 also acts as a cooling fin extending from the bottom plate 31 and cooling plate 26 well into the reservoir of soda 52.

In operation, the source of water communicating through the conduit 34 will typically be under a pressure head in excess of 120 psi generated by the pump 36. The $CO_2$ gas source 42 will typically be under a pressure head of approximately 90 psi. When the level of soda within the tank 28 drops below a predetermined level, the pump 36 is actuated to force water to pass from the water supply through the conduit 34 and serpentine passage 32 of the cooling plate 26. With the cooling plate 26 being in intimate contact with the bottom of the ice bin 16, it has been found that the water coming from the plate 26 and into the conduit 38 is at 50° F. or higher. The water enters the tank 28 until it fills to a desired level, at which time the pump 36 is turned off. However, the $CO_2$ gas is continually introduced into the tank 28 through the spray head nozzle 46 via the conduit 44. Accordingly, a 90 psi pressure head of $CO_2$ gas is maintained in the tank 28 at all times to maintain the desired carbonation level of the soda. During the water filling operation, the plate 50 shields the conduit 54 from $CO_2$ gas bubbles not in solution.

The soda within the tank 28 remains cold due to the intimate contact of the base plate 31 of the tank 28 with the cooling plate 26 which, in turn, is in intimate contact with the base plate 27 which is covered with ice maintained within the bin 16. Further cooling efficiency is attained by the presence of the plate 50 serving as a cooling fin as mentioned above. Accordingly, when the dispensing valve 58 is actuated to dispense a soft drink, the soda from the tank 28 is at a cold temperature, on the order of 35° F., assuring a high level of carbonation, while precluding the likelihood of high levels of ice melt and dilution within the cup. As seen, the tank 28 serves to cool the soda water in a $CO_2$ gas environment enhancing carbonation, rather than simply rechilling the soda water prior to dispensing and in an environment absent any $CO_2$ gas for carbonation.

It should now be readily appreciated that the consumable ice from the ice bin 16 is used for cooling the soda within the soda tank 28, but is kept from contact therewith. It should also be appreciated that only a prechill of the water for generating the soda is necessary by passage of the water through the serpentine passages 32. The dispensing conduit 56 does not require subsequent chilling, since the soda itself is kept at a low temperature by virtue of the tank 28 resting upon the cooling plate 26. Further, the cold temperature of the water introduced into the spray head 40, as well as the cold temperature of the soda itself assures that the carbonation process be efficient and effective.

Those skilled in the art will recognize that so long as sufficient ice is within the bin 16 to cover the bottom plate 27, the cooling function will continue. In other words, the cooling of the soda is substantially independent of the volume or level of ice within the bin 16. Since only the bottom of the bin 16 is employed for heat transfer, the sidewalls may be insulated as at 18 to prevent sweating upon the sidewalls. Additionally, with the base plate 31 of tank 28 integral with the sidewalls thereof, and with the structure of the tank 28 being of stainless steel or similarly thermally conductive material, the entirety of the tank 28 is brought to a low temperature through the interface of the plates 31, 26. With the tank 28 insulated as shown and with the baffle 50 serving as a cooling fan, cooling efficiency is enhanced.

It will also be appreciated that continual cooling is achieved with the invention herein, in contradistinction to prior art systems in which cooling occurred only when water and/or soda were flowing. Temperature variations in the soda are thus reduced, and the quality of the soda greatly enhanced.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A soft drink dispenser, comprising:

an ice bin;

a soda generation and cooling tank maintained external to and thermally interconnected with said ice bin; and a thermally conductive cooling plate in contacting engagement with a bottom plate of said ice bin and a bottom surface of said soda tank, said soda tank having a cooling fin internal thereto and extending upward from a base plate of said tank, said base plate being received upon said cooling plate.

2. The soft drink dispenser according to claim 1, wherein sidewalls of said soda tank are thermally insulated.

3. The soft drink dispenser according to claim 2, wherein a water conduit passes through said cooling plate from a water source to said soda tank.

4. The soft drink dispenser according to claim 3, wherein said cooling plate receives said ice bin and said soda tank upon a common surface of said cooling plate.

5. The soft drink dispenser according to claim 4, further comprising a pump means interposed within said water conduit for selectively passing water from said water source to said soda tank to replenish soda within said tank and wherein a source of carbon dioxide gas is in continual communication with said soda tank, providing a pressure head of carbon dioxide gas thereto.

6. The soft drink dispenser according to claim 4, wherein said water conduit passes through said cooling plate through serpentine passages.

7. A soft drink dispenser, comprising:

an ice bin;

a soda tank in juxtaposition to said ice bin and external to said ice bin sidewalls of said ice bin and said soda tank being thermally insulated from each other;

a cooling plate interconnecting a bottom surface of said ice bin with a bottom surface of said soda tank; and a water conduit interconnecting said soda tank with a source of water, said water conduit being received by said cooling plate.

8. The soft drink dispenser according to claim 7, wherein said cooling plate comprises an aluminum plate.

9. The soft drink dispenser according to claim 8, wherein pump means is provided within said water conduit for selectively introducing water into said soda tank, and a source of carbon dioxide gas is continually applied to said soda tank.

10. The soft drink dispenser according to claim 7, wherein a baffle plate extends upwardly within said soda tank from a base plate of said soda tank opposite said bottom surface, said baffle plate isolating an output conduit from said water conduit and serving as a thermally conductive cooling fin.

* * * * *